US009316432B2

(12) United States Patent
Benavides

(10) Patent No.: US 9,316,432 B2
(45) Date of Patent: Apr. 19, 2016

(54) PROCESS AND EQUIPMENT FOR FAST CHILLING OF CONTAINERIZED BEVERAGES

(71) Applicant: Alfonso Gerardo Benavides, Plano, TX (US)

(72) Inventor: Alfonso Gerardo Benavides, Plano, TX (US)

(73) Assignee: Alfonso Gerardo Benavides, San Ramon, CA (US)

( * ) Notice: Subject to any disclaimer, the term of this patent is extended or adjusted under 35 U.S.C. 154(b) by 0 days.

(21) Appl. No.: 14/068,178

(22) Filed: Oct. 31, 2013

(65) Prior Publication Data

US 2015/0114011 A1 Apr. 30, 2015

(51) Int. Cl.
*F25D 31/00* (2006.01)
*F25D 3/00* (2006.01)

(52) U.S. Cl.
CPC ..... *F25D 31/007* (2013.01); *F25D 2331/805* (2013.01); *F25D 2400/28* (2013.01)

(58) Field of Classification Search
CPC ..... F25D 31/002; F25D 3/00; F25D 31/003; F25D 31/06; F25D 31/007; F25D 31/008
USPC ..... 62/64, 440, 457.4, 340, 338, 393; 222/146.6, 108, 189.06
See application file for complete search history.

(56) References Cited

U.S. PATENT DOCUMENTS

| | | | | | |
|---|---|---|---|---|---|
| 2,525,261 | A * | 10/1950 | Henderson | 221/150 R |
| 4,437,319 | A * | 3/1984 | Iannelli | 62/138 |
| 4,462,220 | A * | 7/1984 | Iannelli | 62/201 |
| 6,240,734 | B1 * | 6/2001 | Ferrier et al. | 62/139 |
| 7,036,326 | B2 * | 5/2006 | Allison | 62/59 |
| 8,459,497 | B2 * | 6/2013 | Milan et al. | 221/150 R |
| 2005/0235657 | A1 * | 10/2005 | Boukas | 62/60 |
| 2007/0051125 | A1 * | 3/2007 | Chiusolo et al. | 62/393 |
| 2010/0000246 | A1 * | 1/2010 | Thiry | 62/228.1 |
| 2010/0282777 | A1 * | 11/2010 | Johnson | 222/146.6 |
| 2011/0011108 | A1 * | 1/2011 | Chadwell et al. | 62/115 |

* cited by examiner

*Primary Examiner* — Mohammad M Ali

(57) ABSTRACT

Soft drinks, beer, energy drinks, flavored drinks, fruit juices, wine, carbonated drinks and other refreshments are kept refrigerated for hours and sometimes days until served for consumption or sold. Energy is spent in chilling them from room temperature to the temperature at which they are to be served or sold and also energy is spent in conserving them at said serving or selling temperature. A process and equipment to rapidly chill beverages in their containers from ambient temperature to the temperature chosen for consumption or sale is presented.

2 Claims, 1 Drawing Sheet

EQUIPMENT FOR FAST CHILLING OF CONTAINERIZED BEVERAGES

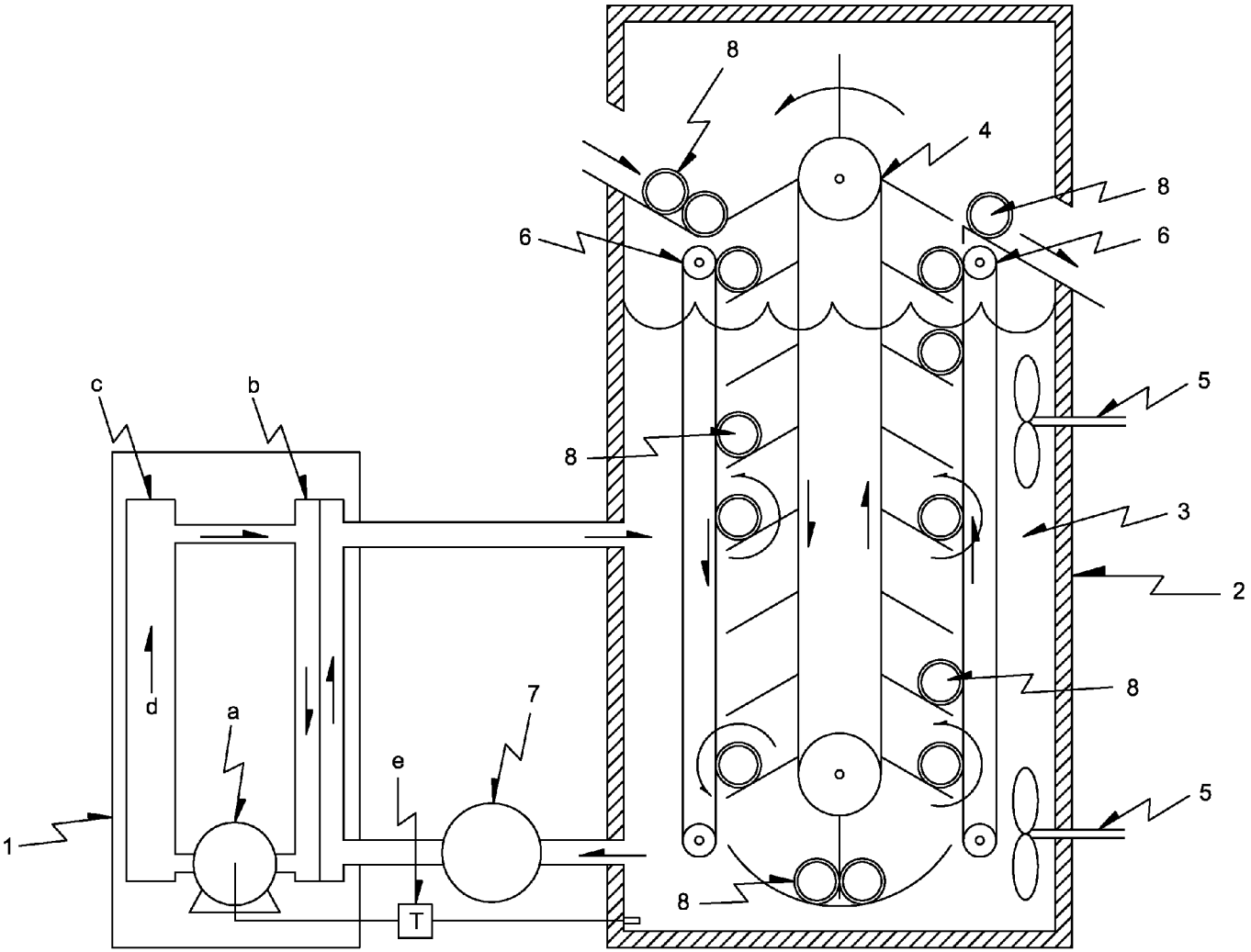
EQUIPMENT FOR FAST CHILLING OF CONTAINERIZED BEVERAGES

PROCESS AND EQUIPMENT FOR FAST CHILLING OF CONTAINERIZED BEVERAGES

BACKGROUND OF THE INVENTION

1. Field of the Invention

The present invention relates to cooling, improvements on cooling, apparatuses for cooling and in particular cooling beverages in their container.

There are plenty of refrigeration systems for a very wide variety of applications in the chemical processing, pharmaceutical and food industry. Fast chilling used to bring substances or food to low temperatures usually involves cryogenics i.e. direct or indirect contact with boiling liquid gases that have a boiling temperature much lower than the freezing point of water. Most refrigeration systems are used to chill air that acts as a heat transfer media between a refrigeration system cooling heat exchanger and an object desired to be chilled. There is a kind of refrigerating systems that consist of a refrigerating fluid that is circulated through a piece of equipment that is designed to make direct contact with a material or substance to be chilled. Nonetheless, none of these systems is designed and meant to rapidly (in a matter of minutes or even seconds) chill one or more beverages in their respective closed containers to bring them to a temperature desired for consumption or sale.

2. Description of the Related Art

Refrigeration is used to extend the shelf life of perishable beverages but also to maintain them at a temperature where they are more enjoyable when served. Perishable beverages need to be kept cold since when placed in their containers and at all times during handling, transportation and storage until consumed or sold. Refrigeration systems that chill a perishable beverage and maintain it cold as it is transported to its container rely on direct contact between the perishable beverage and the cooling heat exchanger of said refrigeration system. Once the beverage is containerized and packaged, packages with containerized beverages are placed in coolers that rely on circulation of cold air acting as a heat transfer media between a refrigeration systems cooling heat exchanger and the packages containing containerized beverages. Heat transfer takes place at a slow rate between the cooler's cooling air and the beverages inside of containers inside of packages, it can take hours for the beverage or beverages in their containers inside of packages to reach thermal equilibrium with the cooler's cooling air.

This also applies to non-perishable containerized beverages that are placed in a cooler or a merchandiser until consumed or sold. Non-perishable containerized beverages do not need to be kept cold since when packaged and can be stored at room temperature to later be moved into a cooler as needed along it is done with enough time ahead before their consumption to allow enough time for them to reach a desired temperature. Energy is spent to bring non-perishable containerized beverages to a desired consumption temperature and also energy is spent to maintain them cold until they are served or sold. In addition, plenty of cooler storage space is needed to allow enough time for a non-perishable containerized beverage to reach a desired temperature and enough time to be kept cold (often also displayed) until consumed or sold.

The present invention provides an option for a non-perishable containerized beverage consumer or merchant where he/she can store non-perishable beverages at room temperature and only chill them in a matter of minutes immediately before being served or sold.

BRIEF SUMMARY OF THE INVENTION

The invention consists in an apparatus that can chill one or more containerized beverages by immersing them in a bath containing a refrigerating liquid that in turn is being circulated or agitated to promote heat transfer from the containerized beverage container outside wall to the refrigerating liquid. More importantly said apparatus will promote stirring inside of the beverage container accelerating heat transfer between the beverage in the container and the inner wall of said beverage container. The chilling of beverage inside of its container is accelerated by utilizing a liquid refrigerant in contact with the outside wall of the beverage container, inducing stirring of liquid refrigerant over the outside surface of the beverage container and inducing stirring of the beverage inside of its container. The beverage container does not need to be opened nor the beverage extracted from its container to be chilled. The apparatus is suitable for beverages in cans, bottles, plastic pouches, cardboard sealed cartons, or plastic sealed containers.

BRIEF DESCRIPTION OF THE DRAWING

An arrangement of components of the equipment subject of this invention is shown in elevation view in FIG. 1. The components shown in FIG. 1 and that are referenced with numerals in parenthesis in the DETAILED DESCRIPTION OF THE INVENTION section are as follows: (1) refrigeration system (including the following sub-components: *a*) heat pump or a refrigeration compressor, *b*) heat exchanger to absorb heat namely a cooling heat exchanger, *c*) heat exchanger to reject heat from the refrigeration system into the environment namely rejecting heat exchanger, *d*) refrigerant carrying heat from the cooling heat exchanger to the rejecting heat exchanger, *e*) thermostat to control temperature of the cooling heat exchanger), (2) immersion bath, (3) refrigerating fluid, (4) containerized beverage transporting and immersing mechanism, (5) refrigerating fluid agitator, (6) containerized beverage agitating mechanism, (7) refrigerating fluid circulation pump, (8) containerized beverage or beverages. FIG. 1 provides a visual illustration of one possible arrangement of the invention subject of this patent and displaying all possible components.

DETAILED DESCRIPTION OF THE INVENTION

The present invention claims an apparatus to rapid chill one or more beverages in their respective closed containers. The desired temperature for a cold beverage is usually between 4 degrees centigrade and above the freezing point of the beverage. The beverage container can be a can, a bottle, a box, a pouch, or other that can be made of metal, glass, plastic, cardboard, or other. Each container presents its specific challenges and therefore the process conditions and equipment will vary somewhat from one item to be cooled to another to accommodate different container shapes, types, materials of construction, capacity and size as well as their contents.

The apparatus of the present invention consists of:

A refrigeration system (1) including the following sub-components: *a*) a heat pump or a refrigeration compressor, *b*) heat exchanger to absorb heat namely a cooling heat exchanger, *c*) heat exchanger to reject heat from the refrigeration system into the environment namely a rejecting heat exchanger, *d*) refrigerant carrying heat from the cooling heat exchanger to the rejecting heat exchanger, *e*) thermostat to control temperature of the cooling heat exchanger. The refrigeration system shall be capable of bringing the cooling heat exchanger to a temperature between 5 and 45 degrees Celsius below zero and preferably between 15 and 20 degrees Celsius below zero An immersion bath (2) holding a refrigerating fluid to chill one or more containerized beverages by direct contact of said refrigerating fluid with the beverages' containers. The bath shall be large enough to house one or more containerized beverages to be chilled, enough refrigerating fluid to immerse said containerized beverage or beverages, any tray or mechanism to hold immerse retrieve or move around the bath said containerized beverage or beverages, and possibly the refrigeration system's cooling heat exchanger as well as an agitator to promote refrigerating fluid circulation in the bath. The refrigerating fluid in the bath may in turn be chilled by circulating it through the refrigeration system's cooling heat exchanger or by using the cooling heat exchanger to cool the immersion bath itself A refrigerating fluid (3) consisting of a Sodium Chloride and/or Calcium Chloride solution in water ranging from 5 to 35% dissolved solids preferably between 15 and 25% dissolved solids A containerized beverage transporting and immersing mechanism (4) to immerse one or more containerized beverages in the bath, maintain said containerized beverage or beverages immersed in the refrigerating fluid for the necessary time to reach the desired temperature and then pull them out A refrigerating fluid agitator (5) or a pump to stir the refrigerating fluid located at the immediate surroundings of the containerized beverage or beverages in the bath A containerized beverage agitating mechanism (6) to frequently or continuously move around, vibrate, agitate, turn, rotate or shake a containerized beverage or beverages while immersed in the bath A refrigerating fluid circulation pump (7) to circulate the refrigerating fluid of the bath in and out or through the cooling heat exchanger of the refrigeration system.

The apparatus subject of the present invention to be operated as follows:

immersing one or more containerized beverages (8) into a cooling bath maintained at a temperature between 7 degrees Celsius below zero and 30 degrees Celsius below zero, and preferably between 15 degrees Celsius below zero and 20 degrees Celsius below zero for a period of time only long enough to reach the desired beverage temperature inside of the container and then remove the unopened container from the cooling bath. The immersion time would be between 15 seconds and 15 minutes but preferentially between 1 and 3 minutes. Frequently or continuously moving around, vibrating, agitating, turning, rotating or shaking the containerized beverage or beverages to be chilled while in the bath with the purpose of stirring the refrigerating fluid in intimate contact with the outside face of the beverage container and also stirring the contents of the containerized beverage or beverages. Said stirring movement shall be at a frequency of 5 to 10000 cycles per minute with a preferred frequency of 10 to 60 cycles per minute. The amplitude of the movement shall be from 1 mil to 1 foot with preferred amplitude of 1/10 of the shortest length of the container or 1/10 of the largest diameter of the container. Stirring the refrigerating fluid making intimate contact with the outside wall of the beverage container either by frequently or continuously moving around, vibrating, agitating, turning, rotating or shaking the containerized beverage or beverages while in the bath or stirring the refrigerating fluid by a circulation pump, an agitator, etc.

EXAMPLE

A 20% Sodium Chloride solution maintained at 17 degrees Celsius below zero is utilized as refrigerating fluid to rapidly cool carbonated drinks cans. A carbonated drink can at an initial temperature of 25 degrees Celsius is immersed for 75 seconds while turning the can over its axis at a rate of 60 rpm in the refrigerating liquid. The refrigerating fluid is being circulated through the fins of the evaporator of a refrigeration system cooling the fluid in the bath. The carbonated drink can is opened to measure the temperature of the contents with a 0-100 degrees Celsius glass thermometer. The contents of the can are found to be at 3.5 degrees Celsius.

I claim:

1. An equipment to chill in a matter of minutes or seconds one or more containerized beverages from room temperature to a desired temperature suitable for consumption, consisting of: A refrigeration system including the following sub-components: a) a heat pump or a refrigeration compressor, b) a heat exchanger to absorb heat namely a cooling heat exchanger, c) a heat exchanger to reject heat from the refrigeration system into the environment namely a rejecting heat exchanger, d) a refrigerant carrying heat from the cooling heat exchanger to the rejecting heat exchanger, e) means of controlling the temperature of the cooling heat exchanger; the refrigeration system is capable of bringing the cooling heat exchanger to a temperature between 5 and 45 degrees Celsius below zero degree Celsius and preferably between 15 and 20 degrees Celsius below zero degree Celsius; an immersion bath holding a refrigerating fluid to chill one or more containerized beverages by direct contact of said refrigerating fluid with the beverages' containers; the bath is large enough to house one or more containerized beverages to be chilled, enough refrigerating fluid to immerse said containerized beverage or beverages, any tray or mechanism to hold immerse retrieve or move around the bath of said containerized beverage or beverages, and the refrigeration system's cooling heat exchanger as well as means to promote refrigerating fluid circulation in the bath the refrigerating fluid in the bath in turn be chilled by circulating the refrigerating fluid through the refrigeration system's cooling heat exchanger or by using the cooling heat exchanger to cool the immersion bath; the refrigerating fluid consisting of a Sodium Chloride and/or Calcium Chloride solution in water ranging from 5 to 35% dissolved solids preferably between 15 and 25% dissolved solids; the containerized beverage transporting and immersing mechanism or means of immersing one or more containerized beverages in the bath, maintain said containerized beverage or beverages immersed in the refrigerating fluid for the necessary time to reach the desired temperature and then pull them out; a refrigerating fluid agitator, a pump or other means of stirring the refrigerating fluid located at the immediate surroundings of the containerized beverage or the beverages in the bath; a containerized beverage agitating mechanism to frequently or continuously move around, vibrate, agitate, turn, rotate or shake a containerized beverage or beverages while immersed in the bath; a refrigerating fluid circulation pump for circulating the refrigerating fluid of the bath in and out or through the cooling heat exchanger of the refrigeration system.

2. A process for an equipment to chill in a matter of minutes or seconds one or more containerized beverages from room temperature to a desired temperature suitable for consumption, consisting of: immersing the containerized beverage or beverages into a refrigerating fluid bath maintained at a temperature between 5 degrees Celsius below zero and 45 degrees Celsius below zero, and preferentially between 15 degrees Celsius below zero and 20 degrees Celsius below zero for a period of time long enough to reach the desired beverage temperature inside of the container or containers and then remove the unopened container or containers from the chilling bath, the immersion time between 30 seconds and 15 minutes but preferentially between 1 and 3 minutes, frequently or continuously moving around, vibrating, agitating, turning, rotating or shaking one or more containerized beverages to be chilled while in the bath by any means with the purpose of stirring the refrigerating fluid in intimate contact with the outside face of the beverage container and stirring the containerized beverage or beverages' contents, said stirring movement shall be at a frequency of 5 to 10000 cycles per minute with a preferred frequency of 10 to 60 cycles per minute, the amplitude of the movement shall be from 1 mil to 1 foot with preferred amplitude of 1/10 of the shortest length of the container or 1/10 of the largest diameter of the container; stirring the refrigerating fluid making intimate contact with the outside wall of the beverage container either by frequently or continuously moving around, vibrating, agitating, turning, rotating or shaking the containerized beverage or beverages while in the bath or stir the refrigerant fluid by means of a circulation pump or an agitator; the stirring of the refrigerating fluid enough to induce a fluid speed between 1 inch/minute to 20 ft/sec with a preferred range of ¼" to 1 inch/sec fluid velocity.

* * * * *